United States Patent [19]

Whiteley

[11] 4,077,388

[45] Mar. 7, 1978

[54] FORCED AIR CIRCULATION HEATING UNIT

[76] Inventor: Isaac C. Whiteley, 1629 S. Canyon Dr., Redmond, Oreg. 97756

[21] Appl. No.: 567,851

[22] Filed: Apr. 14, 1975

Related U.S. Application Data

[63] Continuation-in-part of Ser. No. 545,402, Jan. 30, 1975.

[51] Int. Cl.[2] ..... F24B 7/00

[52] U.S. Cl. ..... 126/121; 126/164; 417/312

[58] Field of Search ..... 237/51; 417/312, 313, 417/360; 126/121, 128, 129, 131, 143, 163, 164, 165

[56] References Cited

U.S. PATENT DOCUMENTS

| | | | |
|---|---|---|---|
| 1,888,711 | 11/1932 | Bourne | 417/312 |
| 2,231,258 | 2/1941 | Elmore | 126/121 |
| 2,258,882 | 10/1941 | Craig | 126/121 |
| 2,828,078 | 3/1958 | Snodgrass | 237/51 |
| 3,001,521 | 9/1961 | Reilley | 126/121 |
| 3,269,383 | 8/1966 | Maasberg | 126/164 |
| 3,799,703 | 3/1974 | Paine et al. | 417/312 |
| 3,866,595 | 2/1975 | Jones | 126/121 |
| 3,930,490 | 1/1976 | Lassey et al. | 126/121 |

FOREIGN PATENT DOCUMENTS

| | | | |
|---|---|---|---|
| 330,745 | 11/1933 | Italy | 126/143 |
| 74,395 | 12/1948 | Norway | 126/121 |
| 1,169,587 | 11/1969 | United Kingdom | 126/121 |

*Primary Examiner*—Ronald C. Capossela
*Attorney, Agent, or Firm*—Robert H. Epstein

[57] ABSTRACT

A forced air circulation heating unit is formed of a U-shaped conduit for placement on the floor of a fireplace and a blower unit including a fan mounted in an insulating housing for forcing air through the conduit to be heated in the fireplace and discharged into a room. The housing has an interior lining of heat and sound insulating material such that the blower unit can be positioned within the fireplace while protecting the fan from heat and reducing noise from the fan. Jets are provided on the conduit to direct streams of air along legs of the conduit toward a base or heating chamber joining the legs in order to force air toward the center of the base and underneath fuel resting on the floor of the fireplace thereby reducing carbon monoxide, facilitating the starting of fires and reducing smoking.

9 Claims, 5 Drawing Figures

FORCED AIR CIRCULATION HEATING UNIT

CROSS-REFERENCE TO RLATED APPLICATION

This application is a continuation-in-part of copending application Ser. No. 545,402 filed Jan. 30, 1975.

BACKGROUND OF THE INVENTION

1. Field of the Invention

The present invention pertains to fireplace heating and, more particularly, to a forced air circulation heating unit for installation entirely within a fireplace to increase heat obtained therefrom.

2. Discussion of the Prior Art

Fireplaces are used a great deal for heating and for the pleasant ambiance produced thereby; however, fireplaces are notorious for the wasted heat and fuel associated therewith in that not only does a great amount of heat created by the burning of fuel, such as wood, coal and the like, escape through the fireplace chimney but heat from the remainder of the house or building housing the fireplace is also exhausted through the fireplace chimney.

There have been attempts in the prior art to provide apparatus for increasing the efficiency of fireplace heating by drawing or forcing air through the fireplace to heat the air and return the heated air to the room, as exemplified by U.S. Pat. 2,642,859 to Brown. Such prior art apparatus, however, have suffered the disadvantages of being relatively bulky, expensive and difficult to install; and, further, such apparatus have invariably drawn air into the fireplace under a support for the burning fuel and forced the heated air out of the fireplace at a location vertically spaced from the indrawn air near the top of the fireplace. The circulation provided by such apparatus is limited, and the burning coals and ashes have tended to be massed at the rear of the apparatus tending to burn out the apparatus.

U.S. Pat. Nos. 2,828,078 to Snodgrass, 3,001,521 to Reilly and 3,240,206 to Schutt are exemplary of prior art appartus for supplying heated air from a fireplace by means of conduits forming parts of grates or incorporating baffles and adapted to have air blown therethrough. While these apparatus provide increased circulation of hot air, they are not as efficient in preserving fuel and obtaining maximum heat from fuel as is desirable.

SUMMARY OF THE INVENTION

Accordingly, it is a primary object of the present invention to provide a forced air circulation heating unit for fireplaces overcoming the above mentioned disadvantages of the prior art.

Another object of the present invention is to provide an integrally formed forced air circulation heating unit for use in a fireplace wherein heated air is discharged at the same level at which cool air is drawn into the fireplace, the forced air circulation heating unit including an insulated housing for a fan to permit the fan to be positioned within the fireplace while protecting the fan from heat and reducing noise from the fan.

Additionally, it is an object of the present invention to enhance the burning of fuel in a fireplace by utilizing jets extending from a conduit running through the firelace to direct streams of air toward the ends of a heat chamber at the rear of the conduit to cause air to continually flow toward the center of the heat chamber thereby producing an even burning of fuel, increasing the amount of hot coals and decreasing pollution exiting through the chimney.

The present invention has further object in that a forced air circulation heating unit for fireplaces is constructed in such a manner that the entire unit including a blower unit can be installed within a fireplace.

Yet another object of the present invention is to provide a forced air circulation heating unit for fireplaces that is formed of a blower unit and a one-piece conduit so as to be easily transported and installed, the installation requiring only the placing of the blower unit and the conduit on the floor of a fireplace.

Additionally, it is a basic object of the present invention to enhance the burning of fuel in a fireplace by directing streams of air at the burning coals thereby assuring complete burning of the coals to minimize the creation of carbon monoxide faclitate starting of a fire and reduce smoking of the fuel, the streams of air being directed from opposite legs of a conduit to force air centrally therebetween and to burn fuel from the bottom such that chimney draft is continuous, fuel is maximally consumed, smoldering and carbon monoxide are prevented and heating is obtained from hot coals rather than flames thereby reducing the amount of fuel required.

A further object of the present invention is to construct a U-shaped conduit for heating air in a fireplace with a base having a larger cross sectional flow area than the cross sectioned flow area of inlet and outlet legs joining the base to form a heating chamber of increased size and, further, to direct streams of air at opposite ends of the base chamber to assure that the coals adjacent the base chamber completely burn at their hottest and thereby increase the heat withdrawn from the fireplace and the efficiency thereof.

Some of the advantages of the present invention over the prior art are that the forced air circulation heating unit of the present invention can be installed entirely within a fireplace thereby increasing asthetic qualities, assures complete burning of fuel, is inexpensive to produce and simple to install requiring no mounting hardware, is small and compact in size to facilitate transportation and handling, provides increased circulation by drawing cold air and discharging heated air at the same level close to the floor, is extremely efficient in fuel burning and heat withdrawn, and the fan is insulated to reduce noise therefrom and to permit the fan to be positioned within a fireplace while maintaining the ambient operating temperature of the motor relatively low.

The present invention is generally characterized in a forced air circulation heating unit for installation in a fireplace including a generally U-shaped conduit having an inlet and an outlet and adapted to be positioned on the floor of the fireplace with the inlet and outlet disposed on opposite sides of the fireplace, and a blower unit including a fan for blowing air through the conduit from the inlet to the outlet such that air forced through the conduit is heated by fuel burned in the fireplace to supply a flow of hot air from the outlet of the conduit and a housing enclosing the fan having an interior lining of heat and sound insulating material whereby the blower can be disposed within the fireplace with the fan protected from heat and noise from the fan reduced.

Other objects and advantages of the present invention will become more apparent from the following description of the preferred embodiment taken in conjunction with the accompanying drawings.

DESCRIPTION OF THE PREFERRED EMBODIMENT

Figure 1:
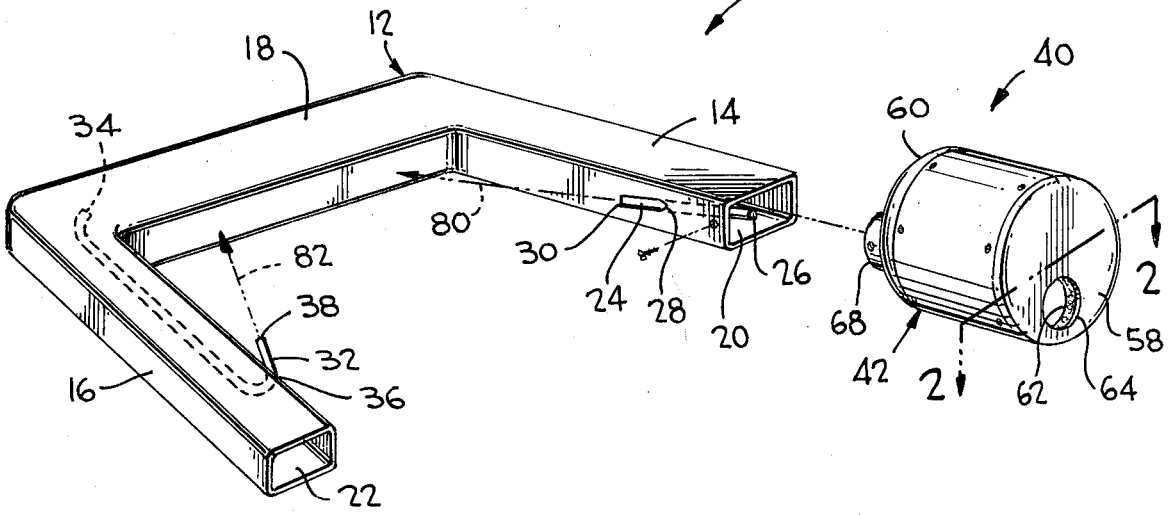
FIG. 1 is an exploded perspective of a forced air circulation heating unit for fireplaces according to the present invention.
Figure 2:
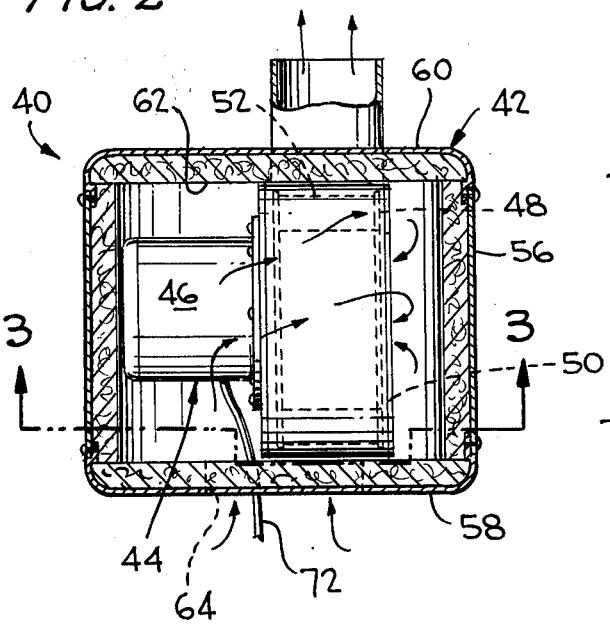
FIG. 2 is a section of the blower unit of the forced air circulation heating unit of FIG. 1.

A forced air circulation heating unit 10 according to the present invention is illustrated in FIG. 1 and includes a pipe or conduit 12 having a generally U-shaped configuration in plan with an inlet leg 14, an outlet leg 16 and a base 18 interconnecting the inlet and outlet legs to define a heating chamber. The inlet leg 14 has an open end forming an inlet opening 20; and similarly, the outlet leg 16 is open at its end to define an outlet opening 22.

The inlet and outlet leg portions are rectangular in cross section and may, for example, be formed of a two-inch by three-inch pipe while the base of the conduit preferably has dimensions greater than those of the inlet and outlet legs, for example, having a rectangular configuration and being made of a two-inch by five-inch pipe such that the cross sectional flow area in the base is greater than the cross sectional flow area in the inlet and outlet legs. The conduit 12 may be formed in any suitable manner, such as with sheet steel or cast iron to provide the desired configuration and relative sizes of the legs and base; however, it is preferred that the wall thickness of the base 18 be greater than that of the inlet and outlet legs to withstand the intense heat to which the base is exposed.

Within the conduit 12 are positioned a small tube 24 having one end 26 thereof positioned adjacent the inlet opening 20, the tube extending through a hole 28 in a side wall of leg 14 to an end 30 positioned within the U-configuration of the conduit 12 at an angle relative to the base 18 to direct a stream of air along the leg 14 at a slight angle thereto toward the side wall of the base. A second small tube 32 is mounted in leg 16 and has an end 34 disposed at the corner where leg 16 joins base 18, the tube 32 extending through a hole 36 in a side wall of leg 16 to an end 38 positioned within the U-configuration of the conduit 12 at a slight angle relative to base 18 for directing a stream of air along leg 16 at a slight angle thereto toward the side wall of base 18. The tubes 24 and 32 form inwardly directed jets to deliver fresh air to the fuel and can be simply made from copper tubing one-half inch in diameter, for example. The tubings 24 and 32 extend approximately two inches from the side walls of legs 14 and 16 such that the ends 30 and 38 thereof are spaced approximately eight inches from the heating chamber 18.

A blower unit 40 forces air through the inlet 20 of the conduit and includes a housing 42 mounting a squirrel cage or centrifugal fan 44 of the type having an electric motor 46 for rotating an impeller 48 having an axial opening 50 for receiving air and carrying blades 52 for tangentially expelling the air via an outlet 54. The housing 42 is formed of a cylindrical body 56 having its ends closed by end caps 58 and 60, and the cylindrical body 56 and the end caps 58 and 60 are made of 26-gauge black sheet metal and have an interior lining of heat and sound insulating material 62, such as Owens-Corning one-half inch fiberglass insulation, the insulating material 62 being secured to the body and end caps with a conventional fireproof cement. The end cap 58 has a $2\frac{3}{4}$ diameter inlet opening 64 therein for drawing cool air into the housing 42, and the end cap 60 has a two-inch diameter outlet opening 66 therein for the discharge of air through a tube 68 mounted in the opening 66, the outlet opening 66 being axially offset from the inlet opening 64. The tube 68 is adapted to be received in the inlet 20 of the conduit 12 to force air through the conduit and through the jet tubing 24.

Figure 3:
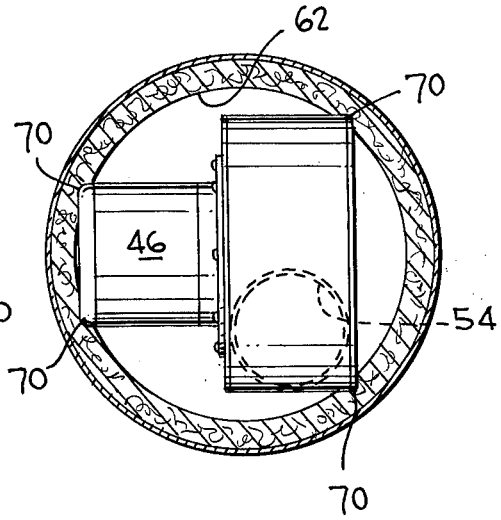
FIG. 3 is a section of the blower unit taken along line 3—3 of FIG. 2.
Figure 4:
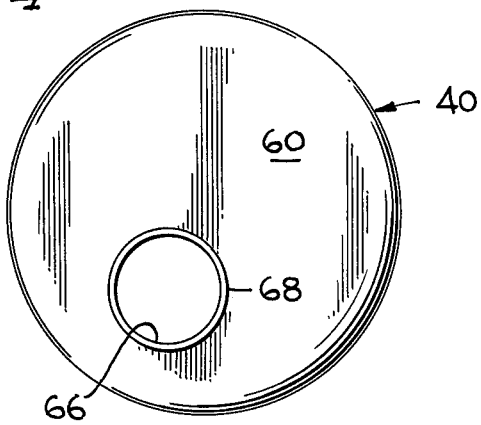
FIG. 4 is a view of the outlet end of the blower unit of the forced air circulation heating unit of FIG. 1.

The fan 44 can be mounted in the housing 42 without fastening means by proper correlation of dimensions of the fan and housing, the fan being held in place by the edges of the motor and impeller depressing and projecting into portions of the insulation as shown at 70 in FIG. 3. The end caps 58 and 60 are mounted on the body 56 by means of inwardly offset lips providing a friction fit with the body 56 and sheet metal screws extending through the body to engage the lips, and the tube 68 is secured to the housing 42 and in the inlet of conduit 12 by means of suitable sheet metal screws.

Figure 5:
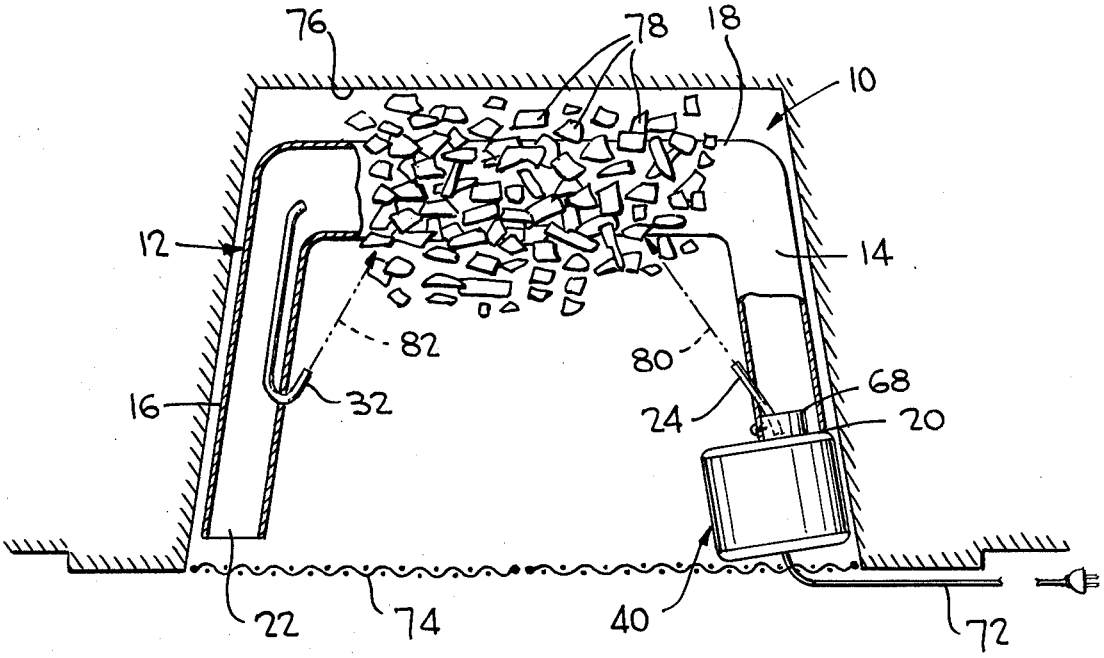
FIG. 5 is a top plan view of the forced air circulation heating unit of FIG. 1 installed in a fireplace.

As shown in FIG. 5, the forced air circulation heating unit 10 of the present invention can be installed in a fireplace by merely positioning the conduit 12 on the floor of the fireplace with the outlet 22 substantially flush with the face of the fireplace and the inlet 20 recessed within the fireplace in order to accommodate the blower unit 40, it being noted that inlet leg 14 is shorter than outlet leg 16 to accommodate the blower unit 40. The conduit 12 can be positiond in the fireplace with the outlet on either side of the fireplace in order to permit hot air circulation to be directed as desired. To this end, the blower unit 40 can be removed from the inlet 20 of the conduit and rotated slightly to permit its positioning on either side of the fireplace with the tube 68 in proper communication with the conduit 12 and the tubing 24. The only portion of the forced air circulation unit 10 which extends beyond the fireplace is the electric cord 72 for the fan 44 which runs through housing inlet opening 64; and, accordingly, with the forced air circulation unit 10 installed in a fireplace, the fireplace can be provided with a metal screen 74 or other suitable device to prevent cinders from entering the room without interference by the forced air circulation heating unit 10.

Installation of the forced air circulation heating unit 10 is extremely simple and only requires the placement of conduit 12 and blower unit 40 in the fireplace with the outlet on the desired side of the fireplace. The fan can be plugged into any available electrical via cord 72, and a switch or other control, such as a baffle, can be provided to selectively operate the fan. The integral structure of the conduit 12 and the small compact structure of the blower unit 40 permit easy handing for transportation and installation and facilitate removal for replacement or repair.

As best shown in FIG. 5, the base or heating chamber 18 of the conduit does not extend to the rear firewall 76 of the firelace but rather is spaced therefrom, preferably by a distance of from four to six inches; and, similarly, the inlet and outlet legs of the conduit need not be disposed in abutting relation with the side firewalls of the fireplace. Thus, it will be appreciated that precise positioning of the forced air circulation heating unit 10 in the fireplace is not required due to the cooperation of the streams of air from tubes 24 and 32 with the heating chamber formed by base 18 which assures that coals 78 on and adjacent the base are red hot.

In operation, fuel to be burned, such as coal, wood or the like, is placed in the fireplace with at least a portion of the fuel positioned on the base 18 of the conduit 12. The force air from fan 44, as well as passing through the conduit 12 to exit at outlet 22, will flow from tubes 24 and 32 to produce small jets or streams of air 80 and 82 directed along the legs 14 and 16, respectively, toward the inner side wall of the base 18 of the conduit at a slight angle thereto. The air flowing through the conduit 12 will be heated by the burning fuel such that a flow of heated air will be discharged from outlet 22 within a range of from 50 to 70 cubic feet per minute, preferably 60 cubic feet per minute. With a moderate fire, the effluent from outlet 22 will have a temperature of approximately 250° F., and the wide opening of the outlet 22 will permit the hot flowing air to diffuse throughout the room. The positioning of the fan 44 and the outlet 22 of the conduit 12 at substantially the same level permits air to be circulated throughout a room or area in an extremely efficient manner at a low level and provides excellent circulation throughout the area without requiring additional pipes or conduits for distrbuting the heated air. The forced air circulation heating unit 10 of the present invention thus creates a circulating system by drawing cold air from the floor level and returning heated air to the same level to replace the withdrawn cold air, the heated air being discharged with sufficient force to be projected beyond the drawing area of the fan.

The jets of air 80 and 82 from tubings 24 and 32 supply air and oxygen to the underside of the fuel laid on top of and adjacent the base 18 of the conduit thereby assuring that the fuel is completely burned from the bottom up and does not lay and smolder thereby minimizing the creation of carbon monoxide gas. Furthermore, the direction of the jets of air 80 and 82 under the fuel maintains live coals and reduces the flames required to produce a given amount of heat while the direction of the jets of air 80 and 82 substantially along legs 14 and 16 respectively, of the conduit causes the air to be continuously forced toward the center of the heating chamber 18 thereby producing even burning of the coals and reducing polluting gases escaping up the chimney. Thus, the forced air circulation heating unit 10 provides fuel saving economy by completely burning fuel and assuring that the coals adjacent the increased area heating chamber formed by base 18 are maintained live and red hot. Other advantages provided by the streams of air from tubes 24 and 32 are that the fresh air and oxygen aid the starting of a fire in the fireplace and create a small flow of air rising up the chimney to reduce smoking and to keep the chimney continously drawing smoke and gas.

The conduit 12 could have any desired cross sectional configuration; however, a rectangular cross sectional configuration is preferred due to its providing a long flat surface for support on the firelace floor and for supporting fuel. Furthermore, the side walls of the conduit define a confined space into which the streams of air from tubes 24 and 32 can be inwardly directed to assure that the air streams contact all of the fuel, Similarly, the conduit 12 can have any suitable configuration in plan as long as a heating chamber is formed at a recessed position in the fireplace thereby providing the generally U-shaped configuration.

By mounting the fan 44 in the housing 42 to form the compact blower unit 40, the blower unit 40, the blower unit can be positioned in the fireplace such that the entire forced air circulation heating unit 10 is out of view, particularly when a fireplace screen is used. The insulating lining 62 protects the fan 44 from the heat in the fireplace, and cool air drawn through housing inlet 64 flows over and around the fan motor 46 such that the heat insulation coupled with the air flow will keep the ambient operating temperature of the motor low. For example, it has been found that with an extremely hot fire in the fireplace, the temperature at the fan motor was 74° F. Another advantage obtained by mounting the fan 44 in the insulatively lined housing 42 is that noise from the motor and fan is substantially reduced, on the order to 75%.

From the above, it should be appreciated that the forced air circulation heating unit 10 of the present invention has many advantages due to the insulative housing of the fan and the use of jets of air directed at the coals. One great advantage is that the forced air circulation heating unit functions from the heat of the coals rather than from flame radiation; and, thus, only a small fire is required to obtain adequate heat circulation. Furthermore, heat is withdrawn from the fireplace after the fire is extinquished and even from the ashes thereby providing increased efficiency and maximum consumption of fuel for heating purposes.

Inasmuch as the present invention is subject to many variations, modifications and changes in detail, it is intended that all subject matter described above or shown in the accompanying drawings be interpreted as illustrative and not in a limiting sense.

What is claimed is:

1. A forced air circulating heating unit for installation in a fireplace comprising a generally U-shaped conduit having an inlet and an outlet and adapted to be positioned on the floor of the fireplace with said inlet and said outlet disposed on opposite sides of the fireplace; and a blower unit including fan means for blowing air through said conduit from said inlet to said outlet such that air forced through said conduit is heated by fuel burned in the fireplace to supply a flow of hot air from said outlet of said conduit and housing means enclosing said fan means having an interior lining of heat and sound insulating material, said housing means including a cylindrical body, a first cap closing one end of said body and a second cap closing the other end of said body, said first cap having an opening therein through which said fan means draws air and said second cap having an opening therein through which air is forced by said fan means into said conduit inlet, and said fan means having an impeller and a motor mounted in said housing means with the edges of said impeller and motor protruding into said insulating material and said motor positioned to be cooled by air drawn through said opening in said first cap whereby said blower unit can be disposed within the fireplace with said fan means protected from heat and noise from said fan means reduced.

2. A forced air circulation heating unit as recited in claim 1 wherein said opening in said second cap is axially offset from said opening in said first cap and said blower unit includes a tube communicating with said opening in said second cap and said conduit inlet.

3. A forced air circulation heating unit as recited in claim 1 and further comprising jet means extending from said conduit for supplying an inwardly directed stream of air toward the fuel whereby starting of a fire in the fireplace is aided, smoking of the fuel is reduced and the fuel is completely burned.

4. A forced air circulating heating unit as recited in claim 1 wherein said conduit is formed of an inlet leg having an end defining said conduit inlet, an outlet leg having an end defining said conduit outlet, and a base joining said inlet and outlet legs, said inlet leg being shorter than said outlet leg to accommodate said blower unit.

5. A blower unit for forcing air through a conduit disposed in a fireplace comprising an electric fan including an impeller and a motor; and a housing enclosing said fan including a cylindrical body with first and second closed ends having openings therein for drawing and expelling air, respectively, and an interior lining of heat and sound insulating material, the edges of said impeller and said motor protruding into said insulating material to wedge said electric fan in said housing whereby said blower unit can be disposed within a fireplace with said fan protected from heat and noise from said fan reduced.

6. A forced air circulating heating unit for installation in a fireplace comprising a generally U-shaped conduit having an inlet and an outlet and adapted to be positioned on the floor of the fireplace with said inlet and said outlet disposed on opposite sides of the fireplace, said conduit being formed of an inlet leg having an end defining said conduit inlet, an outlet leg having an end defining said conduit outlet, and a base joining said inlet and outlet legs, said base being rectangular in cross section to define a top wall for supporting burning fuel and an inner side wall;

jet means extending from said conduit for supplying an inwardly directed stream of air toward the fuel including a first tube extending from said inlet leg for directing a first stream of air at said inner side wall of said base along said inlet leg and a second tube extending from said outlet leg for directing a second stream of air at said inner side wall of said base along said outlet leg whereby starting of a fire in the fireplace is aided, smoking of the fuel is reduced and the fuel is completely burned; and a blower unit including fan means for blowng air through said conduit from said inlet to said outlet such that air forced through said conduit forms said first and second air streams directed at said base and is heated in said conduit by fuel burned in the fireplace to supply a flow of hot air from said outlet of said conduit, and housing means enclosing said fan means having an interior lining of heat and sound insulating material whereby said blower unit can be disposed within the fireplace with said fan means protected from heat and noise from said fan means reduced.

7. A forced air circulation heating unit as recited in claim 6 wherein said first tube has an end adjacent said inlet end of said conduit and extends through a side wall of said inlet leg to an end disposed within the U-shaped configuration of said conduit and said second tube has an end disposed at the joint of said base and said outlet leg and extends through a side wall of said outlet leg to an end disposed within the U-shaped configuration of said conduit.

8. A forced air circulation heating unit as recited in claim 7 wherein said conduit is rectangular in cross section and said base of said conduit has a greater cross sectional flow area than said inlet leg and said outlet leg.

9. A forced air circulating heating unit as recited in claim 6 wherein said fan means has edges protruding into said insulating material to wedge said fan means in said housing means.

* * * * *